United States Patent [19]

Berkeley

[11] Patent Number: 4,615,247

[45] Date of Patent: Oct. 7, 1986

[54] ANTI-KICKBACK SYSTEM

[75] Inventor: James E. Berkeley, Englewood, Ohio

[73] Assignee: Shopsmith, Inc., Dayton, Ohio

[21] Appl. No.: 776,060

[22] Filed: Sep. 13, 1985

[51] Int. Cl.[4] ..... B27G 19/02

[52] U.S. Cl. ..... 83/102.1; 83/447; 83/450

[58] Field of Search ..... 83/102.1, 447, 450, 83/438, 544, 860

[56] References Cited

U.S. PATENT DOCUMENTS

| | | | |
|---|---|---|---|
| 162,814 | 5/1975 | Graves et al. | 83/450 |
| 1,074,198 | 9/1913 | Phillips | 83/450 X |
| 1,132,129 | 3/1915 | Stevens | 83/447 X |
| 1,600,604 | 9/1926 | Sorlien | 83/447 X |
| 2,010,851 | 8/1935 | Drummond | 83/450 X |
| 2,095,330 | 10/1937 | Hedgpeth | 83/102.1 |
| 3,880,032 | 4/1975 | Green | 83/102.1 |

OTHER PUBLICATIONS

R. J. DeCristoforo, Power Tool Woodworking for Everyone, Rev. Ed., 1984, pp. 48–49.

*Primary Examiner*—James F. Coan

*Attorney, Agent, or Firm*—Biebel, French & Nauman

[57] ABSTRACT

An anti-kickback system for use with a table saw or the like consists of a splitter adapted to be mounted on the table saw and including an elongated slot therethrough inclined relative to the table top, a pair of cams, each having peripheral, work-engaging surface including a spiral segment, and a pin attached to the cams and extending through the slot to form a pivot axis for the cams at approximately the centers of the spiral segments. The slot is sized to slidably receive the pin and includes an upper, elongated edge having a plurality of arcuate shaped detents sized to receive the pin. Movement of a workpiece in a kickback condition beneath the cams causes the cams to be pivoted and displaced upwardly to lock the pin against one of the detents so that the workpiece is clamped between the table top and a portion of the spiral segment of the cams. The spiral is shaped such that any point of contact of the segment with a workpiece in a kickback condition is at a radius extending to the pivot center of a cam which makes an angle of approximately 8° with a line extending through the pivot axis perpendicularly to the table top.

15 Claims, 5 Drawing Figures

ANTI-KICKBACK SYSTEM

BACKGROUND OF THE INVENTION

The present invention relates to powered woodworking tools and, more particularly, to anti-kickback devices which are incorporated into the splitters of table saws, radial arm saws, and the like.

A table saw typically consists of a substantially flat table top having a centrally-located slot, a saw motor adjustably mounted beneath the table top, and a saw blade mounted on an output spindle of the saw motor and positioned to protrude upwardly through the table slot. The motor is mounted on the table saw such that the saw blade, normally disk-shaped, rotates in a direction opposite that which the workpiece is fed into the saw blade. Most table saws include a saw fence for guiding a workpiece during ripping operations, and a miter gauge, which slides in a slot in the table orientated parallel to the saw blade, for guiding a workpiece to perform cross-cutting operations.

If the saw blade should bind in the kerf of a workpiece during a ripping or cross-cutting operation, the blade grabs the adjacent portion of the workpiece and tends to carry it along as it rotates. This rotational movement of the saw blade causes the workpiece to be kicked upwardly and rearwardly back toward the operator abruptly and with great force and speed. This occurrence, known as "kickback," may result from a number of conditions, such as the use of a dull saw blade or one with insufficient set, making a freehand cut, cross-cutting against the rip fence, releasing the workpiece before it has been fed completely past the saw blade, or cutting a defective wooden workpiece.

In order to prevent the occurrence of kickback, most table saws are fitted with splitters and with kickback fingers. A splitter is a flat plate, preferably made of steel, which projects upwardly from the saw table and lies in a common plane with, and to the rear of, the saw blade. The splitter is positioned adjacent to the saw blade and the side of the splitter immediately adjacent to the saw blade has an arcuate contour which corresponds to the curve of the periphery of the saw blade, so that the splitter extends partially about the circumference of the saw blade.

A splitter is as thick as, or is slightly thinner than the saw blade so that it fits within the kerf made by a saw blade as a workpiece is fed past it. A splitter prevents the kerf from closing around the saw blade so that the body of the saw blade is prevented from binding against the sides of the cut workpiece.

Kickback fingers typically consist of a pair of elongate pawls pivotally mounted at one end to the splitter and spring biased to extend downwardly and rearwardly toward the saw table. The pawls are attached to both sides of the splitter and include teeth formed in a lower edge. The teeth point rearwardly so that the pawls do not grip a workpiece as it is fed into the saw blade.

In such a normal feed situation, the pawls pivot upwardly and ride over the upper surface of the workpiece. However, if kickback occurs, the sudden upward and reverse movement of the workpiece causes the teeth to dig into the upper surface of the workpiece and the pawls pivot forwardly to jam the workpiece against the table, thereby preventing its reverse movement from continuing.

A disadvantage with anti-kickback systems of this type is that, under certain circumstances, the teeth of the kickback pawls do not engage a workpiece in a kickback situation. This may occur when cutting plastics or wood laminates which have smooth, relatively hard upper surfaces which cannot be easily gripped by the teeth of the pawls. Another situation occurs when a relatively thick workpiece is used which causes the pawls to pivot upwardly sufficiently that the teeth are orientated at an angle which makes it difficult to engage the upper surface of the workpiece.

Accordingly, there is a need for an anti-kickback system which can accommodate workpieces made of plastic and wood laminates as well as wood, and can accommodate workpieces having varying thicknesses. Furthermore, there is a need for an anti-kickback system in which the workpiece is not damaged by teeth or other gripping means if a kickback situation occurs.

SUMMARY OF THE INVENTION

The present invention is an anti-kickback system which is used with table saws and the like and comprises a splitter having an inclined slot therethrough which includes a plurality of detents and a cam having a peripheral, work-engaging surface which includes a spiral segment. The cam is pivotally attached to the splitter by a pin which extends through the geometric center of the spiral segment and is slidably received within the slot. The spiral is curved so that the portion of the spiral segment having the greatest radius from the center is located in a downstream or rearward extending direction.

In operation, a workpiece being fed into the spinning saw blade of the associated table saw passes beneath the cam and the engagement of the upper surface of the workpiece causes the cam to be displaced upwardly so that the pin is displaced upwardly within the slot. At the same time, the cam rotates against the workpiece so that the downstream or rearward portion of the cam is raised above the pivot axis.

During a kickback occurrence, the sudden reverse movement of the workpiece causes the cam to rotate in a direction opposite to that during a workpiece feeding condition, so that the upper surface of the workpiece encounters the portion of the segment having an increasingly larger radius. This causes the pin to be displaced upwardly into an adjacent one of the detents, thereby preventing further sliding movement of the pin in the slot, and the portion of the spiral segment engaging the upper surface of the workpiece jams the workpiece downwardly against the table top, to prevent further reverse movement.

Because the workpiece is held against the table top by a wedging action with the kickback cam rather than by engagement with teeth of the kickback pawls, there is no need to provide the periphery of the cam with teeth, ribs, knurling or the like which could mar the surface of the workpiece. Furthermore, since no portion of the cam need penetrate the surface of the workpiece to hold it from being kicked back in a kickback situation, the kickback system works as effectively with plastics and wood laminates as it does with wood workpieces.

Another advantage of the invention is that the cam is urged downwardly against the upper surface of a workpiece by the force of gravity upon the cam. As a result of the shape and orientation of the spiral segments, the point of contact between the cam and the upper surface of a workpiece will always be downstream or rearwardly of the pivot connection to the splitter. Consequently, there is no need for springs or other means to bias the cam against a workpiece. Since the point of contact will never be positioned directly beneath the pivot connection of the cam, the necessary wedging action will always occur.

In a preferred embodiment, the spiral segment is shaped that the radius from the point of contact with a workpiece to the pivot axis forms an angle of approximately 8° with a line perpendicular to the table top, regardless of the orientation of te cam relative to the workpiece. In some types of table saws, such as that shown in the Folkerth U.S. Pat. No. 4,494,591 and commonly assigned, the table pivots about an axis which is oriented parallel to the plane of the saw blade, which allows bevel cuts to be made. When used with such a table saw, the spiral segment of the cam is shaped such that a radius from a point of contact forms an angle of approximately 8° with a line perpendicular to a line lying in the plane of the table and extending parallel to the plane of the saw blade.

It has been found that the shape of such a spiral segment may be determined by the following equation:

$$r=(\sin 8°)\theta+C$$

where r is the radius of a point on the spiral segment to the center of the spiral, $\theta$ is the angle that the radius makes with a selected datum radius, and C is the length the datum radius.

The advantage of a spiral segment that provides a constant angle of 8° between the contact point and pivot point is that the cam functions to jam the workpiece against the table top by the same mechanism that a self-locking tapered pin engages an appropriately-sized bore. The constant increase in radius of approximately 8°, which is deemed in the art to be a "self-locking angle" for such a tapered pin, gives a similar result when applied to the spiral shape of the cam surface. While a locking spiral angle of 8° has been found to be optimal, angles of 7° or less have been found highly effective. The self-locking aspect appears to decrease drastically as the locking angle increases beyond 8°.

Also in the preferred embodiment, the cam includes a rectilinear segment which extends from the datum radius opposite the spiral segment. During a workpiece feeding operation, the cam is caused to rotate to a position in which the smallest radius (which would be the datum radius defined in the preceding paragraph) contacts the workpiece. The rectilinear segment adjacent to the datum prevents the cam from continuing to rotate past the datum and flipping upside down since it presents a rather long surface area to contact a workpiece and which extends well upstream or forwardly of the pivot point.

It should be noted that the functioning of the cams, and therefore the effectiveness of the entire anti-kickback system, is not dependent on a splitter of the type previously described, which extends into the kerf of the workpiece rearwardly of the blade. Rather, any member capable of supporting the cams above the saw table and having a detent slot to accept the connecting pin will allow the cams to jam a workpiece against the saw table during a kickback occurrence. However, the splitter does perform the useful function of preventing the kerf from closing about the circular saw blade during a cutting operation.

Accordingly, it is an object of the present invention to provide an anti-kickback system which is relatively inexpensive to manufacture and yet is capable of gripping workpieces of varying thicknesses and surface hardnesses; an anti-kickback system which employs a wedging action to engage a workpiece rather than a puncturing or other type of purely frictional type of engagement to hold a workpiece; and an anti-kickback system which does not require springs or other means to bias the kickback members downwardly into engagement with a workpiece.

Other objects and advantages of the invention will be apparent from the following description, the accompanying drawings, and the appended claims.

DETAILED DESCRIPTION OF THE PREFERRED EMODIMENT

Figure 1:
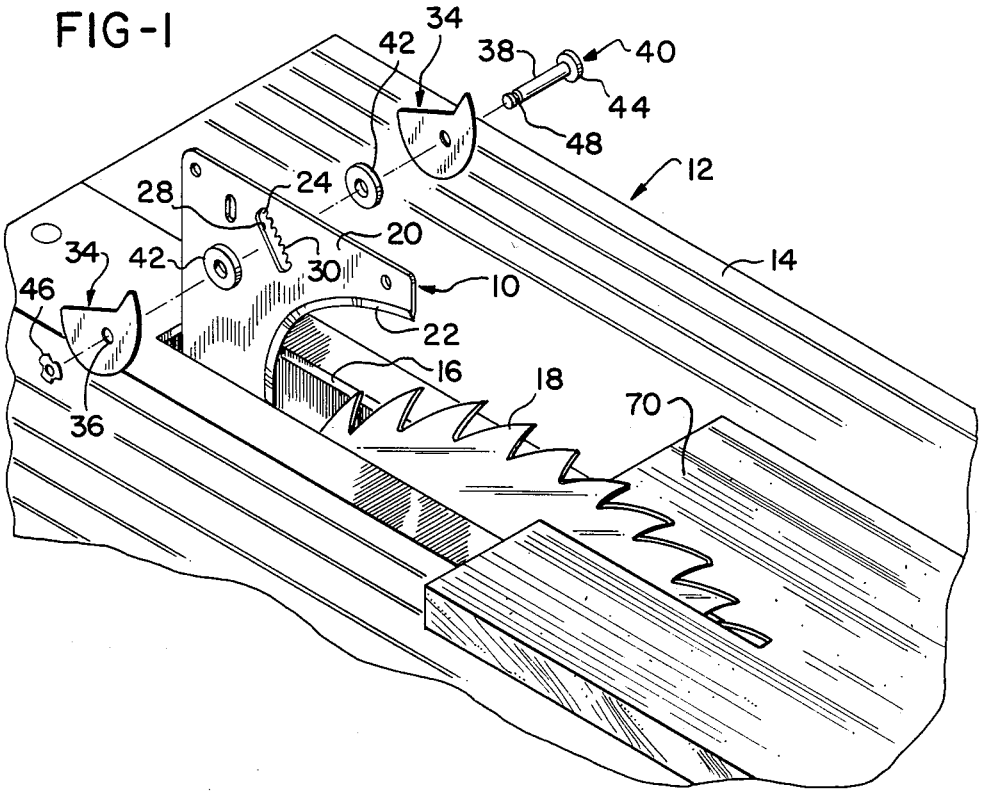
FIG. 1 is an exploded, perspective view of a preferred embodiment of the anti-kickback system mounted on a table saw.

As shown in FIG. 1, a preferred embodiment of the anti-kickback system of the present invention, generally designated 10, is adapted to be mounted on a table saw 12 which includes a relatively flat saw table 14 having a slot 16 through which a circular saw blade 18 protrudes. The saw blade 18 is mounted on the output spindle of an electric motor (not shown) mounted beneath the saw table 14 in a manner well-known in the art. Although the following discussion is directed to the anti-kickback system 10 as used in combination with a table saw 12, it is within the scope of the invention to utilize the anti-kickback system 10 with a radial arm saw or other motorized saw having a circular saw blade which makes a through-cut in a workpiece.

The anti-back system 10 includes a flat, plate-shaped splitter 20 having a thickness which is slightly less than the thickness of the blade 18 and a forward edge 22 having an arcuate shape which corresponds in curvature to the circumference of the saw blade. The splitter 20 is mounted on the table saw 12 by well-known means (not shown) such as, for example, engagement with a lower saw guard of the type described in the co-pending patent application of Bartlett et al., Ser. No. 741,421, filed June 5, 1985, the disclosure of which is incorporated herein by reference. With such a design, the splitter 20 protrudes upwardly through a forward portion of the slot 16 and is fixed in position relative to the blade 18. In these respects, the splitter 20 is similar to splitters commonly used with high-quality table saws.

Figure 3:
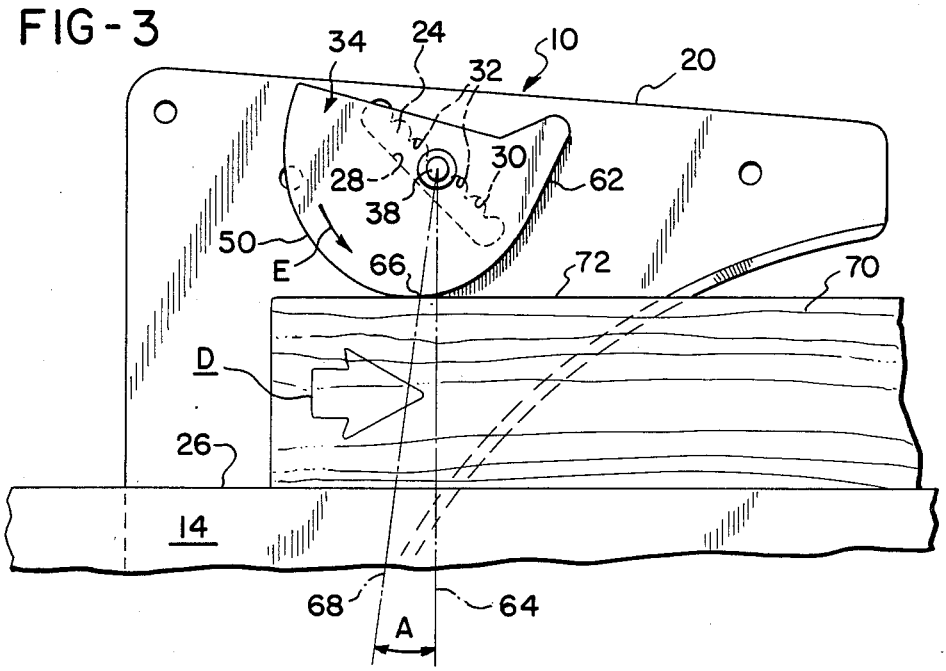
FIG. 3 is a side elevation of the anti-kickback system of FIG. 1 in which a cam has been rotated to a wedging position during a kickback occurrence.

As shown in FIGS. 1 and 3, the splitter 20 of the present invention also includes a slot 24 which is elongate in shape and is inclined relative to the surface 26 of the saw table 14 in a rearward direction. For reasons that will become apparent later in this discussion, it is preferable that the slot be oriented at about 40° to 50° to the table top, with 45° being optimal. The rearward, lower edge 28 of the slot 24 is relatively smooth, while the forward upper edge 30 includes a plurality of arcuate detents 32.

The anti-kickback system 10 also includes a pair of cams 34 which include holes 36 that receive the shank 38 of a pin 40. The pin 40 extends through the holes 36 and through the slot 24 so that the cams 34 are supported on the splitter 20 by the pin. The cams 34 are spaced from the splitter 20 by washers 42 which are positioned on either side of the splitter and are mounted on the shank 38. The entire assembly of cams 34 and washers 42 are clamped together by the head 44 of the pin 40 on one side and a lock washer 46, which engages an annular recess 48 on the shank 38, on the other side.

Figure 2:
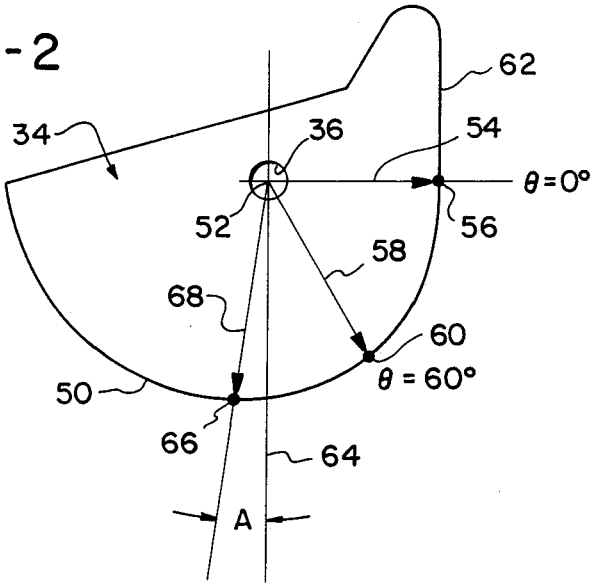
FIG. 2 is a side elevation of a cam of the embodiment of FIG. 1.

As shown in FIGS. 2 and 3, the cams 34 each include a spiral segment 50 which is shaped such that the center of the spiral coincides with the pivot axis 52 of the cam, which is formed by the shank 38 of the pin 40 which passes through the hole 36. The shape of the spiral is determined by the equation:

$$r=(\sin 8°)\theta+C$$

where r equals a radius from a point on the spiral segment 50 to the center 52 of the pivot axis, $\theta$ is the angle of that radius from a selected datum radius 54, and C is the length of datum radius 54. Thus, datum radius line 54 is the shortest radius of the spiral segment 50, so that a point 56 on the spiral segment at the end of datum radius 54 is the closest to the center 52. The radius at each successive point from point 56 along spiral segment 50 increases in length.

For example, the length of radius line 58 at point 60, which is located on segment 50 at an angle of $\theta=60°$ from the datum radius 54, would be calculated as follows:

$$\begin{aligned} \underline{r} &= (\sin 8°)(60°) + \underline{C} \\ &= (0.1391)(1.047) + \underline{C} \\ &= 0.1456 + \underline{C} \end{aligned}$$

Accordingly, the length of radius line 58 is 0.1456 units longer in length than datum radius 54. In a prototype constructed according to the invention, the datum radius was determined to be 0.780 inches (19.81 mm), so that, in the above equation, C=00.78. Therefore, the radius of point 60 would be approximately 0.926 inches (23.52 mm) for $\theta=60°$.

The cams 34 are oriented such that the spiral segment 50 increases in radius from the center 52 in rearward or downstream direction, so that the center of gravity of the cam is positioned downstream of the point 52.

The cam 34 also includes a rectilinear segment 62 which extends from side of the datum radius 54 opposite spiral segment 50 and is oriented to be tangential to the point 56 at the end of the radius 54. As a result of the specific curve of the spiral segment 50, the cam 34 will, regardless of its radial orientation relative to a workpiece, contact that workpiece at a point on the spiral segment which at a radius which makes an angle of approximately 8° with a line perpendicular to the table top 14 (FIG. 3).

Figure 5:
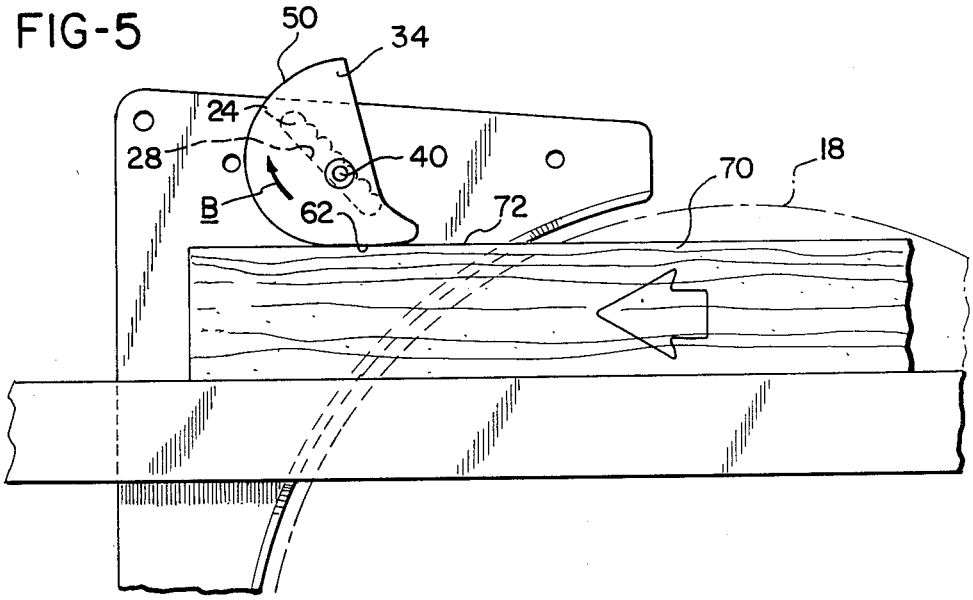
FIG. 5 is a side elevation of the anti-kickback system of FIG. 1 showing the cam rotated during a workpiece feeding occurrence.

For example, if the line perpendicular to the table top is shown as line 64 in FIG. 5, the cam 34 will be oriented such that the point of contact with a workpiece is point 66 which is on a radius 68 that makes an angle A of approximately 8° with the line 64. It should also be noted that the point of contact will always be rearward or downstream of a line extending through the center 52 and perpendicular to the table top.

Figure 4:
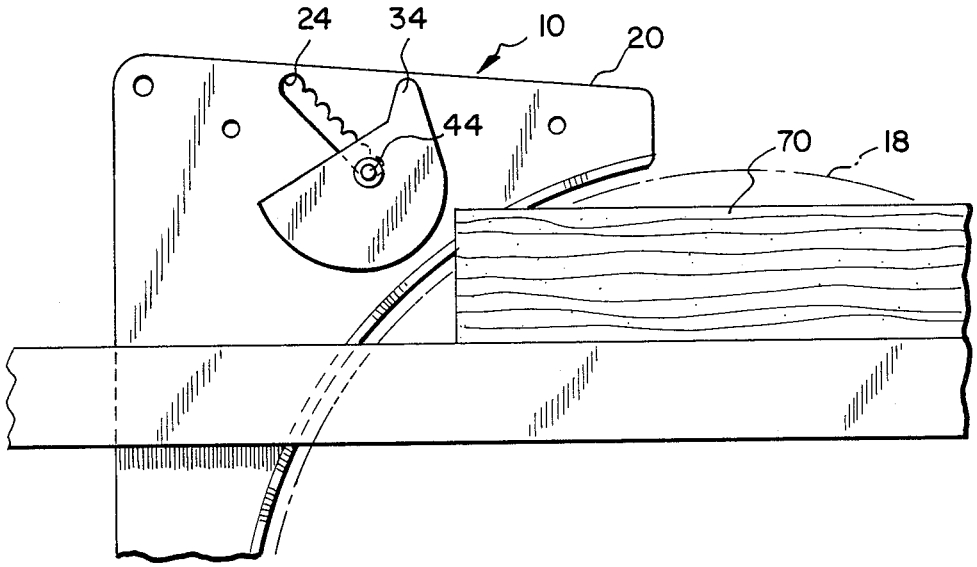
FIG. 4 is a side elevation of the anti-kickback system of FIG. 1 showing an orientation of the cam prior to engagement with a workpiece.

The operation of the anti-kickback system 10 is as follows. As shown in FIG. 4, prior to contact with a workpiece 70, the cams 34 hang freely by the pin 44 which extends through the lowest portion of the slot 24 in the splitter 20. The cutting operation begins with the actuation of the motor to rotate the saw blade 18 in a clockwise direction.

As shown in FIG. 5, the workpiece is fed into the rotating blade 18 and a kerf (not shown) is formed by the cutting action of the blade. The splitter 20, which is coplanar with the blade, is therefore within the kerf cut by the blade and does not disturb the workpiece 70. As the workpiece passes beneath the cams 34, contact with the spiral segments 50 causes the cams to rotate in a clockwise or downstream direction, indicated by arrow B, until the upper surface 72 of the workpiece contacts the rectilinear segment 62. Continued feeding of the workpiece 70 causes the upper surface 72 to slide relative to the rectilinear segment 62 of the cams 34. In addition, the thickness of the workpiece 70 causes the cams 34 to be lifted slighty upward, which results in the pin 40 traveling upwardly and rearwardly in the slot 24 against the edge 28.

A kickback occurrence is illustrated in FIG. 3. In such an event, the rapid rearward movement of the workpiece 70 in the direction of arrow D causes the cams 34 to rotate in a counter-clockwise direction, as indicated by the arrow E. This rotation causes the points of contact between the cams 34 and the upper surface 72 to progress from the rectilinear segments 62 to points along the spiral segments 50. In addition, as these points of contact progress along the spiral segments 50, the radius from the points of contact to the centers 52 (FIG. 2) increases, which causes the cams 34 to be displaced upwardly until the pin 40 engages one of the detents 32 of the slot 24. The angle of inclination of the slot 24 of about 45° allows maximum vertical travel of the pin 40 and cams 34 while still allowing the detents 32 to receive the pin 40.

At this time, the points of contact 66 between each of the cams 34 and the upper surface 72 is along the radius 68 on the cams which is at an angle A of approximately 8° with the line 64 perpendicular to the table top 14 (FIG. 1). The workpiece is clamped between the table top 14 and the cams 34 so that its rearward movement ceases.

After the workpiece is so clamped, the motor should be shut off and the workpiece removed from engagement with the blade 18 (FIG. 1) which is accomplished by displacing the workpiece slightly rearwardly, thereby disengaging the upper surface 72 from its clamping engagement with the cams 34, then, while the cams 34 are held away from the workpiece 70, the workpiece is slid forwardly away from the splitter 20 and blade 18.

In the preferred embodiment, the cams 34 preferably are made of 12-gauge cold rolled steel having a thickness of approximately 0.1046 inches (2.657 mm). The washers 42 and pin 40 preferably are made of low carbon steel which is plated with zinc or cadmium to inhibit rust.

While the form of apparatus herein described constitutes a preferred embodiment of the invention, it is to be understood that the invention is not limited to this precise form of apparatus, and that changes may be made therein without departing from the scope of the invention.

What is claimed is:

1. For use with a table saw of the type having a table top for supporting a workpiece and a motor-driven circular saw blade, an anti-kickback system comprising:

splitter means adapted to be mounted on a table saw and including slot means therethrough inclined relative to an associated table top;

cam means having a peripheral, work-engaging surface including a spiral segment;

pin means attached to said cam means and extending through said slot means to form a pivot axis for said cam means at approximately a center of said spiral segment; and said slot means being sized to slidably receive said pin means and including an upper, elongate edge having detent means shaped to receive said pin means; whereby upward and rearward movement of a workpiece in a kickback condition beneath said cam means causes said cam means to be pivoted and be displaced to a locked configuration such that said pin means engages said detent means and a portion of said spiral segment contacts an upper surface of a workpiece thereunder in a wedging engagement with an associated table top.

2. The system of claim 1 wherein said spiral segment is shaped such that a radius extending from said portion of said spiral segment to said pivot axis makes an angle not greater than about 8° with a line perpendicular to an associated table top.

3. The system of claim 1 wherein a contour of said spiral segment is determined by $$r=(\sin 8°)\theta+C,$$

where r is a distance from a point on said spiral segment to said pivot axis, $\theta$ is an angle from a selected datum radius, and C is a length of said datum radius.

4. The system of claim 1 wherein said work-engaging surface includes a substantially rectilinear segment positioned adjacent to said spiral segment such that said rectilinear segment engages an upper surface of a workpiece passing beneath said cam means during a feeding operation.

5. The system of claim 3 wherein said work-engaging surface includes a substantially rectilinear segment extending from said datum radius opposite said spiral segment, whereby said cam means pivots about said pivot point so that said rectilinear segment engages an upper surface of a workpiece passing thereunder during a feeding operation.

6. The system of claim 5 wherein said cam means is positioned relative to said splitter means such that said rectilinear segment extends from said datum radius in a direction opposite a workpiece feeding direction.

7. The system of claim 6 wherein said cam means is positioned relative to said splitter such that said work-engaging surface spirals outwardly from said pivot axis in a workpiece feeding direction.

8. The system of claim 1 wherein said detent means includes a plurality of concave portions, each sized to receive said pin means therein.

9. The system of claim 8 wherein said slot means is elongate in shape and makes an angle of about 45° with an associated table top.

10. For use with a table saw of the type having a table top for supporting a workpiece and a motor-driven, circular saw blade, an anti-kickback system comprising:

cam means having a peripheral, work-engaging surface including a spiral segment;

means for mounting said cam means above a table of table saw; and means for pivotally attaching said cam means to said mounting means at approximately a center of said spiral segment.

11. The anti-kickback system of claim 9 wherein said spiral segment is shaped such that a radius extending from a point of contact between said spiral segment and a workpiece to said pivot means makes an angle not greater than about 8° with a line perpendicular to an associated table top.

12. For use with a table saw of the type having a flat table top and a saw blade rotatably mounted therebeneath and protruding upwardly therethrough, an anti-kickback system comprising:

a splitter adapted to be attached at a lower portion thereof to a table saw and extend upwardly from a table top thereof, said splitter having an elongate slot therein inclined upwardly and forwardly relative to an associated table top and including an upper edge having a plurality of arcuate detents therealong and a relatively smooth lower edge;

a pair of cams disposed on either side of said splitter, each of said cams having a peripheral, work-engaging surface including a spiral segment having a curvature defined by $$r=(\sin 8°)\theta+C,$$

where r is a length of a radius from a point on said spiral segment to a center thereof, $\theta$ is an angle said radius makes with a selected datum radius, and C is a selected length of said datum radius from said spiral center to a point on said spiral segment at said datum, said spiral being oriented such that r increases in a rearward, work feeding direction, and a rectilinear segment extending from said datum radius in a forward direction opposite said spiral segment;

a cylindrical pin extending through said slot and said cams at said centers of said spiral segments thereof, thereby forming pivot axes for said cams, said pin having a diameter sized to fit within said arcuate detents; and spacer means mounted on said pin between said cams and said splitter, whereby upward and rearward movement of a workpiece in a kickback condition beneath said cams causes said cams to be pivoted and displaced to a locked configuration such that said pin engages one of said detents and a portion of said spiral segment contacts an upper surface of a workpiece thereunder in locking engagement with an associated table top.

13. In a table saw of the type having a table top for supporting a workpiece and a motor-driven, circular saw blade, an anti-kickback system comprising;

cam means having a peripheral, work-engaging surface includng a spiral segment;

means for mounting said cam means above said table top; and means for pivotally attaching said cam means to said mounting means at approximately a center of said spiral segment.

14. The anti-kickback system of claim 13 wherein said spiral segment is shaped such that a radius extending from a point of contact between said spiral segment and a workpiece to said pivot means makes an angle not greater than about 8° with a line perpendicular to said table top.

15. In a table saw of the type having a flat table top and a saw blade rotatably mounted therebeneath and protruding upwardly therethrough, an anti-kickback system comprising;

a splitter adapted to be attached at a lower portion thereof to said table saw and extend upwardly from said table top thereof, said splitter having an elongate slot therein inclined upwardly and rearwardly relative to said table top and including an upper edge having a plurality of arcuate detents therealong and a relatively smooth lower edge;

a pair of cams disposed on either side of said splitter, each of said cams having a peripheral, work-engaging surface including a spiral segment having a curvature defined by $$r=(\sin 8°)\theta+C,$$

where r is a length of a radius from a point on said spiral segment to a center thereof, $\theta$ is an angle said radius makes with selected datum radius, and C is a selected of said datum radius from said spiral center to a point on said spiral segment at said datum, said spiral being oriented such that r increases in a rearward, work-feeding direction, and a rectilinear segment extending from said datum radius in a forward direction opposite said spiral segment;

a cylindrical pin extending through said slot and said cams at said centers of said spiral segments thereof, thereby forming pivot axes for said cams, said pin having a diameter sized to fit within said arcuate detents; and spacer means mounted on said pin between said cams and said splitter, whereby upward and rearward movement of a workpiece in a kickback condition beneath said cams causes said cams to be pivoted and displaced to a locked configuration such that said pin engages one of said detents and a portion of said spiral segment contacts an upper surface of a workpiece thereunder in locking engagement with said table top.

* * * * *